United States Patent [19]

Cappel

[11] 4,419,932

[45] Dec. 13, 1983

[54] SEPARATOR FOR INK FOUNTAIN

[75] Inventor: Bert Cappel, Muhlheim, Fed. Rep. of Germany

[73] Assignee: M.A.N.-Roland Druckmaschinen Aktiengesellschaft, Fed. Rep. of Germany

[21] Appl. No.: 331,214

[22] Filed: Dec. 16, 1981

[30] Foreign Application Priority Data

Dec. 29, 1980 [DE] Fed. Rep. of Germany ... 8034726[U]

[51] Int. Cl.[3] ..... B41F 1/46

[52] U.S. Cl. ..... 101/363; 101/210

[58] Field of Search ..... 101/207, 208, 210, 363

[56] References Cited

U.S. PATENT DOCUMENTS

| | | | |
|---|---|---|---|
| 1,400,704 | 12/1921 | Welsh | 101/210 |
| 1,893,148 | 1/1933 | Page | 101/210 |
| 1,919,283 | 7/1933 | Troy | 101/210 |
| 1,920,419 | 8/1933 | Miller | 101/210 |
| 1,953,105 | 4/1934 | Flinker | 101/210 |
| 2,301,535 | 11/1942 | Green | 101/210 |
| 2,514,653 | 7/1950 | Lerch | 101/210 |
| 2,525,363 | 10/1950 | Luehrs | 101/210 X |
| 3,339,485 | 9/1967 | Rytterholm | 118/694 X |
| 3,831,517 | 8/1974 | Wagner | 101/208 |

*Primary Examiner*—Edgar S. Burr
*Assistant Examiner*—John A. Weresh
*Attorney, Agent, or Firm*—Leydig, Voit, Osann, Mayer & Holt, Ltd.

[57] ABSTRACT

For use with an ink fountain having a trough with a flat sloping bottom wall and a fountain roller at the presented edge of the bottom wall, a moveable partition for dividing the trough into adjacent feeding and non-feeding areas. The partition consists of a trough-engaging portion having a straight face for engaging the bottom wall of the trough and a separate roller-engaging portion having an arcuate face for engaging the roller surface. Resilient sealing strips are secured to the faces thereof for sealing against the flat bottom wall of the trough and the cylindrical surface of the roller. The two portions are so arranged that their adjacent edges overlap to block the escape of ink, and are connected one to the other by a pivot which extends parallel to the roller axis in the region of the overlap. The pivot is fitted loosely to provide play in the plane of the partition so that when the trough-engaging portion is clamped downwardly and forwardly in the direction of the fountain roller, the roller-engaging portion is free to undergo rocking and translational movement for intimate seating of the arcuate face thereof on the fountain roller notwithstanding variations in the transverse positioning of the roller axis vertically and horizontally with respect to the bottom wall of the trough.

6 Claims, 6 Drawing Figures

SEPARATOR FOR INK FOUNTAIN

It is conventional to divide the ink fountain of a printing press into adjacent feeding and non-feeding areas by the use of a partition consisting of a unitary element as disclosed in the Green U.S. Pat. No. 2,301,535 which issued Nov. 10, 1942. Conventionally, such partitions provide felt, rubber or similar resilient materials for sealing against the flat bottom wall of the trough and the cylindrical surface of the fountain roller to prevent the seepage of ink. The resilient materials would also compensate for very slight variations in the transverse positioning of the roller with respect to the trough portion of the fountain.

The Rytterholm U.S. Pat. No. 3,339,485 for an adjustable ink supply device in rotary printing presses, which issued Sept. 5, 1967, discloses a partition having two elements, both of which engage the fountain roller. One element of the partition has a recess for the second element which is pivotally journaled on a pin to undergo slight rotational movement to compensate for very small variations in the positioning of the fountain roller. Neither the Green nor the Rytterholm patent discloes a partition which is adjustable for greater variations in the positioning of the fountain roller or which is adaptable to different printing presses having fountain troughs inclined at varying angles with respect to the horizontal plane.

Accordingly, it is an object of the present invention to provide a separator for an ink fountain which is reliable and leak proof and which may be adapted to a variety of ink fountains normally available in the marketplace without necessity for modification or adjusting to size. It is a related object of the invention to provide an ink separator which intimately engages the fountain roller notwithstanding variations in the vertical and horizontal positioning of the roller axis with respect to the bottom wall of the fountain trough, and which may be made using no more than normal machining tolerances.

It is another object of the invention to provide a separator for an ink fountain which is portable and which is quick and simple to secure in position.

It is yet another object to provide a device for dividing the feeding and non-feeding areas of an ink fountain which is economical, inherently durable and long lived.

Other objects and advantages of the invention will become apparent upon reading the attached detailed description and upon reference to the drawings in which.

While the invention has been described in connection with a preferred embodiment, it will be understood that I do not intend to be limited to the particular embodiment shown but intend, on the contrary, to cover the various alternative and equivalent constructions which may be included within the scope and spirit of the appended claims.

Figure 1:
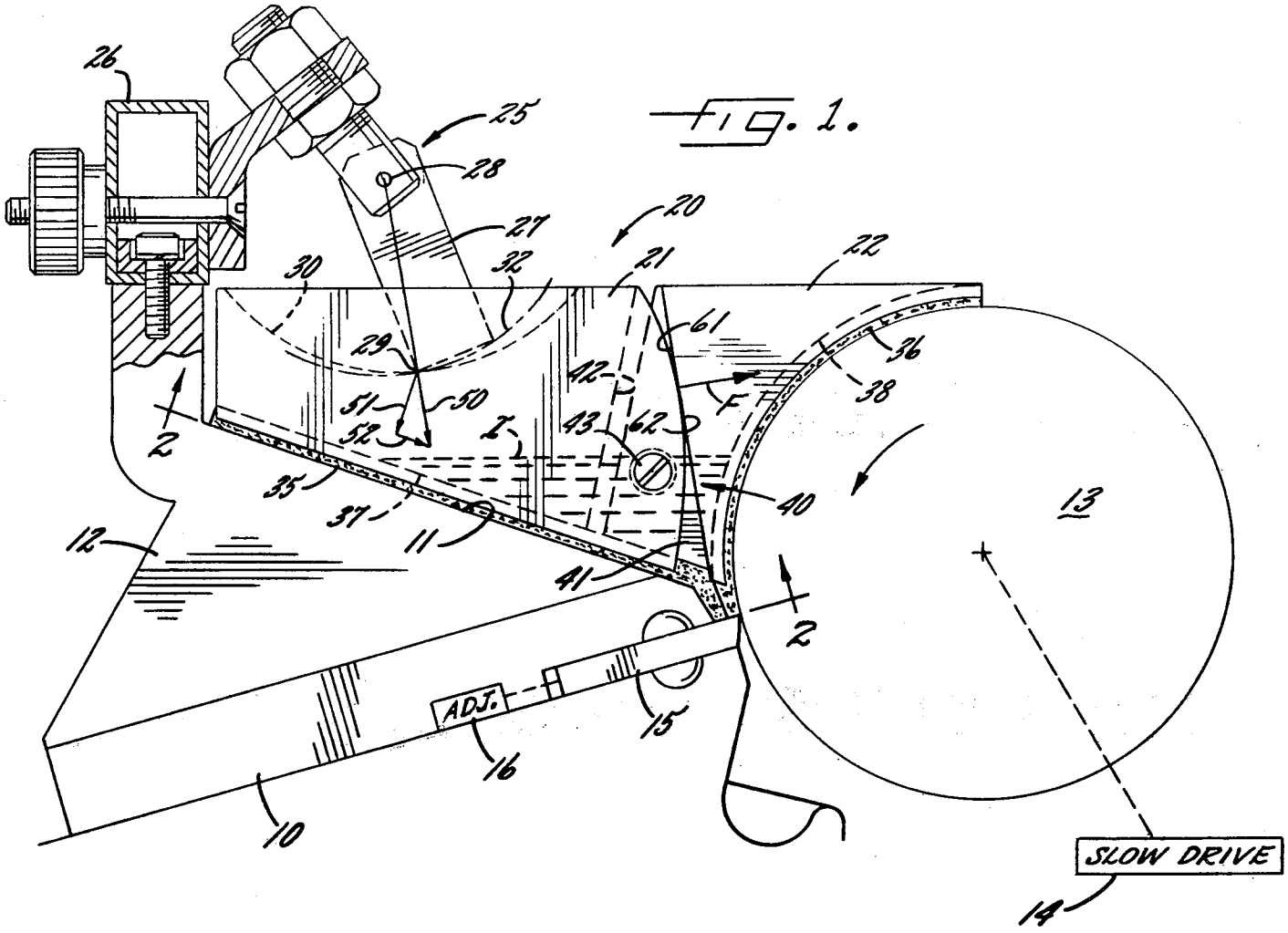
FIG. 1 is a side elevation of a separator for an ink fountain constructed in accordance with the invention.
Figure 2:
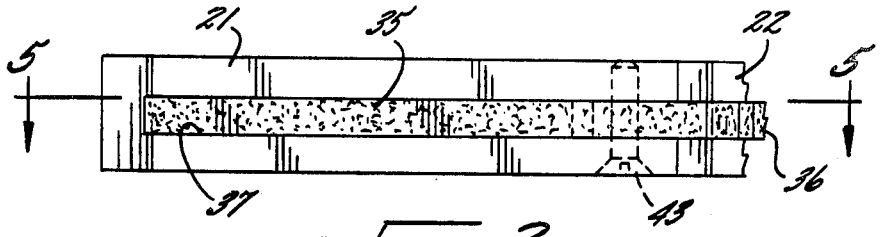
FIG. 2 is a fragmentary bottom view looking along line 2—2 in FIG. 1.
Figure 3:
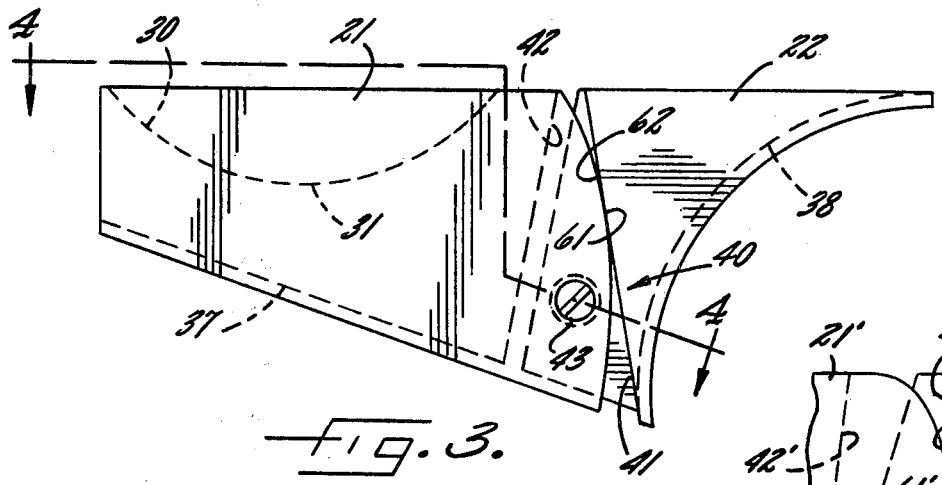
FIG. 3 is a side elevation of the trough-engaging portion and the roller-engaging portion without the resilient sealing strips.

Turning now to the drawings, there is disclosed in FIG. 1 an ink fountain for printing presses having a horizontally extending relatively massive frame 10 having an inclined trough 11 with a flat sloping bottom wall and a vertical outer surface 12. A fountain roller 13 is shown at the presented edge of the bottom wall with means 14 for driving the fountain roller. Mounted upon the inclined surface 11 is an adjustable horizontally extensive metering device or blade 15 which cooperates with the surface of the fountain roller 13. The metering device is preferably segmented, with each segment being provided with an adjusting device 16. A body of ink I is contained between the trough and the fountain roller. The metering device is spaced slightly from the surface of the fountain roller to produce a longitudinal gap which determines the thickness of a film of ink transmitted by the fountain roller in successive column positions, the film being transferred via a series of conventional inking rollers to the printing plate (not shown). A movable partition 20 consisting of a trough-engaging portion 21 and a roller-engaging portion 22 is secured in position by a clamp 25 so as to engage the bottom wall of the trough and the cylindrical surface of the fountain roller. The clamp 25 includes a base 26 securable in a selected longitudinal position along the frame 10 having a clamping dog 27 which, pivoted to the base at 28, has a presented edge 29 at its lower end. The dog registers with a groove 30 formed in the trough-engaging portion 21 of the partition, the groove having an arcuate bottom surface 31 which is eccentric with respect to the arc of swing 32 of the clamping dog. Resilient sealing strips 35, 36 recessed in respective grooves 37, 38 block the seepage of ink.

In accordance with one aspect of the present invention, the trough-engaging portion and the roller-engaging portion of the movable partition are joined to permit relative articulation and shifting movement in the vertical plane so that the resilient sealing strips are in sealing engagement over their entire length, notwithstanding variations in the transverse positioning of the fountain roller axis vertically and horizontally with respect to the bottom wall of the trough.

Figure 4:
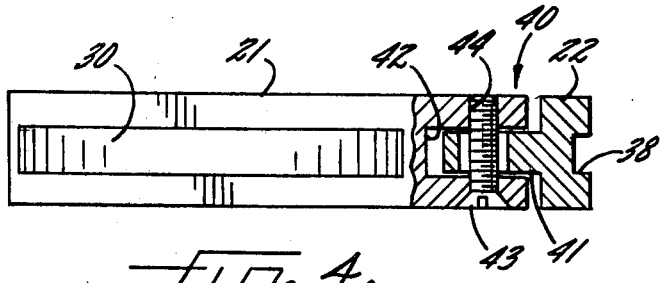
FIG. 4 is a top view looking along line 4—4 in FIG. 3.

In the present instance, the trough-engaging portion 21 and the roller-engaging portion 22 are arranged in a vertical plane with their adjacent edges in overlapping relation providing an articulated connection 40 formed of a tongue 41 and groove 42. It is contemplated that the trough-engaging portion and the roller-engaging portion may be pivoted together by a threaded element such as a machine screw 43 which penetrates both of them in a direction parallel to the roller axis and which is spaced upwardly from the bottom wall of the trough. The screw is preferably loosely fitted to provide play in all directions in the plane of the partition so that the roller-engaging portion is free to undergo rocking and translational movement as well as pivoting with respect to the trough-engaging portion. In this way, provision is made for considerable variation between successive troughs in which the partition may be used. In order to secure the portions rigidly together after accommodation to the relative positioning of the roller axis with respect to the bottom wall of the trough, the remote wall of the groove is tapped as at 44 (FIG. 4) so that turning the screw pulls the opposed walls of the groove into clamping engagement.

The partition, as mentioned, is portable and of relatively light construction so that it may be easily installed and positioned. The trough-engaging portion is moved along the bottom wall of the trough 11 laterally, accompanied by clamp 25, with the roller-engaging portion in contact with the cylindrical surface of the fountain roller 13. In accordance with the invention, the trough-engaging portion of the partition is clamped downwardly and forwardly in the trough so that it exerts a first component of force in a direction to press the first sealing strip 35 against the bottom wall of the trough and a second component of force in a direction to press the curved sealing strip 36 against the cylindrical surface of the fountain roller to produce a tight, sealed fit at all points of contact. As shown in FIG. 1, the arc of swing 32 of the clamping dog 27 intersects the arcuate bottom wall 31 in the groove 30 at a shallow angle and with such orientation that swinging the dog downwardly, accompanied by wedging action, produces a force 50 composed of a first, or normal, force component 51 against the bottom wall of the trough 11 and a second force component 32 which is transmitted to the trough-engaging portion to exert a sealing force against the surface of the fountain roller 13. While this aspect of the invention has been described in connection with the clamping dog shown in FIG. 1, one skilled in the art will appreciate that other clamping means may be employed to generate the same force components without departing from the invention.

Figure 6:
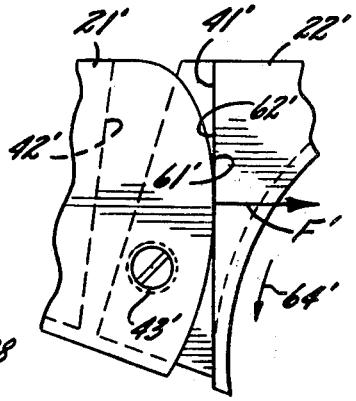
FIG. 6 is a fragmentary side elevation of an alternate trough-engaging portion and roller-engaging portion constructed in accordance with the present invention.
Figure 5:
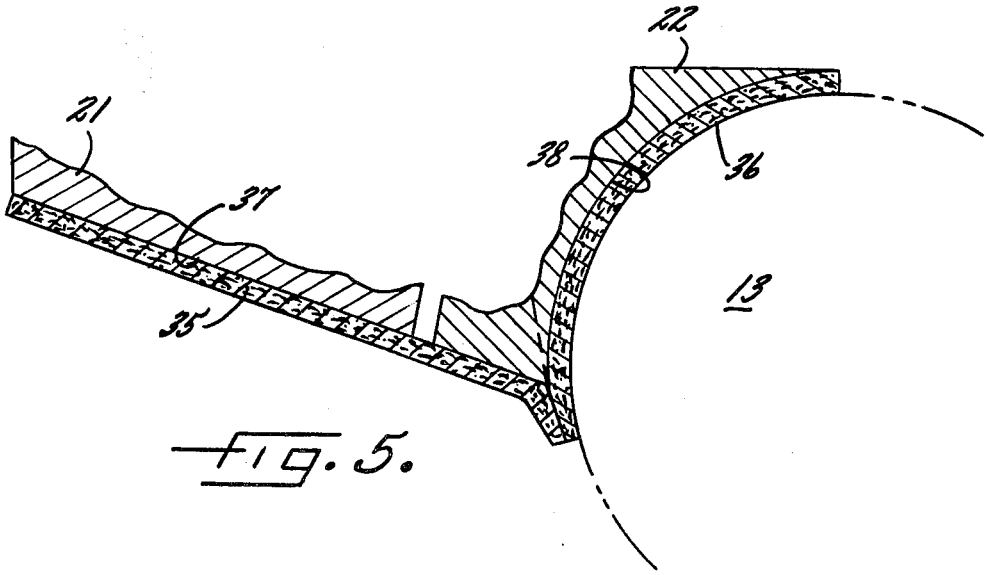
FIG. 5 is a fragmentary vertical cross-sectional view along line 5—5 in FIG. 2.

For the purpose of transmitting the second component of force 52 to the roller-engaging portion 22, the trough-engaging portion and the roller-engaging portion may have respective mutually abutting surfaces 61, 62 for transmission of force between them, as shown in FIG. 1. It is to be noted that at least one of the surfaces 61, 62 should be curved in the vertical plane for the transmission of force, with line contact in all positions of articulation, and so that the force vector applied to the roller-engaging portion passes through the central portion of the arcuate face which is in engagement with the cylindrical surface of the roller. And preferably, the abutting surfaces 61, 62 should be shaped so that the force F exerted between them passes through the central portion of the fountain roller 13. As will be noted in the alternate embodiment of FIG. 6, where similar parts are represented by the same reference numerals with the addition of a prime, the abutting surfaces may be contoured, if desired, to produce a force F′ at a lower angle so that the sealing force exerted on the fountain roller is more uniform along the arcuate face of the roller-engaging portion. Incidentally, it may be noted that the sealing force exerted on the roller-engaging portion 21′ by the clamp 25′ (not shown in FIG. 6) tends to be augmented by the frictional force 64′ generated by the rotating fountain roller.

In the preferred forms of the invention discussed above, the resilient sealing strips 35, 36 have a generally rectangular cross-section and are nestingly received in shallow grooves 37, 38. It is not essential to the invention, however, that the sealing strips be of rectangular cross-section, or that the sealing strips be secured to the partition in shallow channels. One skilled in the art will appreciate that sealing strips having other cross sections may be employed and that any other means may be used to secure the sealing strips to the respective faces of the partition.

It is therefore one of the features of the present construction that a leakproof seal is achieved, regardless of the placement of the ink separator in the trough of the ink fountain, and notwithstanding variations in the positioning of the fountain roller axis with respect to the bottom wall of the trough.

I claim as my invention:

1. For use in an ink fountain of the type having a trough with a flat sloping bottom wall terminating in an edge, a fountain roller rotatable about an axis and having a cylindrical surface extending closely parallel to said edge with means for driving the fountain roller so that ink is fed in the form of a thick film at the edge of the bottom wall, the combination comprising a movable partition for dividing the trough into adjacent feeding and non-feeding sections, said partition comprising a trough-engaging portion having a straight face and a separate roller-engaging portion having an arcuate face, the portions having adjacent edges, the portions being arranged in a vertical plane with their adjacent edges in overlapping relation to block escape of ink, the portions having resilient sealing strips secured to the faces thereof for sealing against the flat bottom wall of the trough and the cylindrical surface of the roller respectively, the portions having force transmitting abutments for transmission of force perpendicular to said axis between them, one of said abutments being a curved surface so as to provide line contact between said abutments, the portions being pivoted together in the region of overlap by a pivot which extends parallel to the roller axis, means for clamping the trough-engaging portion downwardly and forwardly in the direction of the fountain roller, the pivot being loosely fitted to provide play in all directions in the plane of the partition so that, when the trough-engaging portion is seated on the sloping surface of the trough and clamped downwardly and forwardly in the direction of the fountain roller, the roller-engaging portion is free to undergo slight rocking and translational movement with respect to the trough-engaging portion for intimate seating of the arcuate edge thereof on the fountain roller notwithstanding variations in the transverse positioning of the roller axis vertically and horizontally with respect to the bottom walls of the trough.

2. For use with an ink fountain of the type having a trough with a flat sloping bottom wall terminating in an edge, a fountain roller rotatable about an axis and having a cylindrical surface extending closely parallel to said edge with means for driving the fountain roller so that ink is fed in the form of a thick film at the edge of the bottom wall, the combination comprising a movable partition for dividing the trough into adjacent feeding and non-feeding sections, said partition comprising a trough-engaging portion having a straight face for engaging the bottom wall of the trough and a separate roller-engaging portion having an arcuate face for engaging the roller surface, the portions having adjacent edges and having means along their adjacent edges for joining the portions to one another to prevent loss of ink between them, the portions having straight and arcuate resilient sealing strips secured to their respective faces, the portions having force-transmitting abutments for transmission of force perpendicular to said axis between them, one of said abutments being a curved surface so as to provide line contact between said abutments, means for clamping the trough-engaging portion of the partition in the trough so that it exerts a first component of force in a direction to press the straight sealing strip against the bottom wall of the trough and a second component of force in a direction to press the arcuate sealing strip against the surface of the roller, the joining means having provision for accommodating slight relative articulation and shifting movement of the roller-engaging portion of the partition in the vertical plane so that the sealing strips are pressed into sealing engagement over their entire length notwithstanding variations in the transverse positioning of the roller axis vertically and horizontally with respect to the bottom wall of the trough.

3. The combination as claimed in claim 1 or in claim 3 in which the mutually abutting surfaces are shaped so that the force vector applied to the roller-engaging portion passes through the central portion of the arcuate face which is in engagement with the cylindrical surface of the roller.

4. The combination as claimed in claim 1 in which the overlapped edges between the trough-engaging portion and roller-engaging portion are shaped so that they together form a tongue-and-groove connection and in which the pivot is in the form of a pin penetrating the tongue-and-groove connection and which is spaced upwardly from the bottom wall of the trough.

5. The combination as claimed in claim 1 in which means are provided for rigidly securing the trough-engaging portion and the roller-engaging portion together after accommodation to the relative positioning of the roller axis with respect to the bottom wall of the trough.

6. The combination as claimed in claim 1 in which the pivot connection between the trough-engaging portion and the roller-engaging portion is in the form of a threaded element with means for screwing the same tight to secure the portions rigidly together after accommodation to the relative positioning of the roller axis with respect to the bottom wall of the trough.

* * * * *

UNITED STATES PATENT AND TRADEMARK OFFICE

CERTIFICATE OF CORRECTION

PATENT NO. : 4,419,932

DATED : December 13, 1984

INVENTOR(S) : Bert Cappel

It is certified that error appears in the above-identified patent and that said Letters Patent is hereby corrected as shown below:

Col. 1, Line 25, change "discloes" to -- discloses --

Col. 3, Line 24, change "32" to -- 52 --

Col. 4, Line 44, change "walls" to -- wall --

Col. 5, Line 13, change "3" to -- 2 --

Signed and Sealed this

*Ninth* Day of *October 1984*

[SEAL]

*Attest:*

GERALD J. MOSSINGHOFF

*Attesting Officer*

*Commissioner of Patents and Trademarks*